US006006957A

United States Patent [19]

Kunesh

[11] Patent Number: 6,006,957

[45] Date of Patent: Dec. 28, 1999

[54] ACTUATOR OVERCAP FOR A PRESSURIZED CANISTER

[75] Inventor: Edward J. Kunesh, Franksville, Wis.

[73] Assignee: S. C. Johnson & Son, Inc., Racine, Wis.

[21] Appl. No.: 09/036,204

[22] Filed: Mar. 6, 1998

[51] Int. Cl.[6] ..... B65D 83/00

[52] U.S. Cl. ..... 222/402.13

[58] Field of Search ..... 222/182, 402.1, 222/402.13, 402.21, 402.22, 402.23

[56] References Cited

U.S. PATENT DOCUMENTS 3,058,626 10/1962 Hibbs et al. .
4,132,333 1/1979 Debard .
4,254,899 3/1981 van Lit .

FOREIGN PATENT DOCUMENTS 2023745 6/1979 United Kingdom .
2099513 5/1981 United Kingdom .
96/03208 12/1996 WIPO .

*Primary Examiner*—Andres Kashnikow
*Assistant Examiner*—Jorge Bocanegra

[57] ABSTRACT

Disclosed herein are actuator overcaps for aerosol canisters. They permit automated preassembly of button actuators with overcaps via a modified receiving pod. The pod has an adjustment rib, an axial retention groove and a downward open side slot. Caressing arms assist in supporting the pod.

5 Claims, 4 Drawing Sheets

ACTUATOR OVERCAP FOR A PRESSURIZED CANISTER

CROSS REFERENCES TO RELATED APPLICATIONS

Not applicable

STATEMENT REGARDING FEDERALLY SPONSORED RESEARCH

Not applicable

BACKGROUND OF THE INVENTION

The present invention relates to aerosol canisters and particularly to improved actuator caps suitable for mounting on such canisters.

Hand-held aerosol cylindrical dispensers are known that are filled with material to be dispensed through a nozzle by a propellant gas. Frequently the product is dispensed as a finely divided spray, but may alternatively be dispensed as a foam or a relatively thin jet.

A typical aerosol canister has a valve mounted at its upper end, to which a delivery mechanism is mounted.

The valve often has a short projecting tube (a valve stem) on which the delivery mechanism is mounted, although sometimes the delivery mechanism may project into the canister through an aperture to make contact with the valve. A dip tube usually extends downwardly from the valve into the canister, up which product is forced by a propellant when the valve is opened.

Small button actuators with nozzles are known for use with such aerosol dispensers. Some button actuators release product as a result of downward pressure on the actuator, while others release product in response to sideways pressure on the actuator (depending on the type of valve used). The button actuators can be installed by being pushed down on to the valve stem (due to a friction fit of the valve stem in a lower bore of the button actuator).

A separate overcap typically fits onto the cylindrical canister to protect the button actuator from accidental operation. However the use of a separate cap which has to be removed before the button actuator can be accessed is inconvenient. To overcome the disadvantages of a separate cap, caps have been developed that incorporate actuator features so that they can be left in place on the canister when the aerosol dispenser is used.

For example, U.S. Pat. No. 3,058,626 discloses a cap whose diameter is substantially the same as that of the canister on which it is mounted and which has a depressed valley running across the top of the cap. There is a separate actuator button mounted on the valve underneath the outer cap. The valley portion of the cap mentioned above may be depressed to depress the underlying actuator button. Spray passes from the nozzle in the actuator button through a frontal aperture in the protective cover (which is kept in alignment with the nozzle by a rib in the cover which slides within a groove in the actuator button). Unfortunately, there is no good means of holding the actuator button on the cover so that they can be handled as a unit.

An improved overcap system is described in PCT/GB96/03208. However, that system relies on a somewhat complex receiving pod in an actuator overcap to retain and align the actuator button. The pod can be difficult to use with certain types of automated assembly equipment.

There is thus a need for an improved overcap for use with aerosol dispensers.

BRIEF SUMMARY OF THE INVENTION

In one aspect, the invention provides an actuator overcap adapted to fit on a pressurized canister. The cap has an outer shroud adapted to fit on the canister. The shroud is designed with an aperture in its side.

An inner pod linked to the shroud is provided for receiving a button actuator of the canister. The pod has a side slot which is aligned with the aperture so as to allow spray to pass from the button actuator through the slot and aperture and out the shroud.

The side slot is open at its lower end. The pod has means for restricting rotation of the button actuator relative to the pod and means for axially retaining the button actuator in the pod.

There is also an actuator panel that carries the pod and is hingedly mounted to the shroud to pivot the panel relative to the shroud.

In a preferred form of the invention the pod has an inner circumferential groove for receiving a radially extending projection on the button actuator. There are two caressing arms that extend down from the actuator panel and lend flexible support to the sides of the pod.

In a further embodiment, there is a process for mounting a spray cap on a valve stem of an aerosol canister. One preassembles a button actuator and the overcap. One then mounts the preassembly on the valve stem (preferably in an automated assembly line).

The aerosol canister is preferably of the type having a radially extending rim running around the top of its outer cylindrical wall. The outer shroud of the spray cap is designed to be push fit onto this outer rim at the same time as the valve stem is inserted into the button actuator portion of the preassembly.

In this specification references to top and bottom or upper and lower are to be understood as referring the orientation of a component when it is in place on a cylindrical canister which is itself in an upright position. Outer and inner are to be considered in relation to the outer cylindrical wall of such a canister.

References to "aerosol" in this specification are not to be understood in the strict scientific sense of a very fine dispersion of liquid droplets in air. Rather, the term is used in a way familiar to those concerned with packaging to cover the dispensing of products (usually consumer products) from pressurized containers.

The objects of the invention therefore include providing actuator caps of the above kind:

(a) that permit automated assembly of an actuator overcap with a valve with reduced risk of breaking the overcap;

(b) which are suitable to be inexpensively molded from plastic;

(c) which securely retain a button actuator; and (d) which are operable over extended periods of time without replacement.

These and still other objects and advantages of the present invention (e.g. methods for assembling them with aerosol canisters) will be apparent from the description which follows. The following description is merely of the preferred embodiments. Thus, the claims should be looked to in order to understand the full scope of the invention.

DETAILED DESCRIPTION

Figure 1:
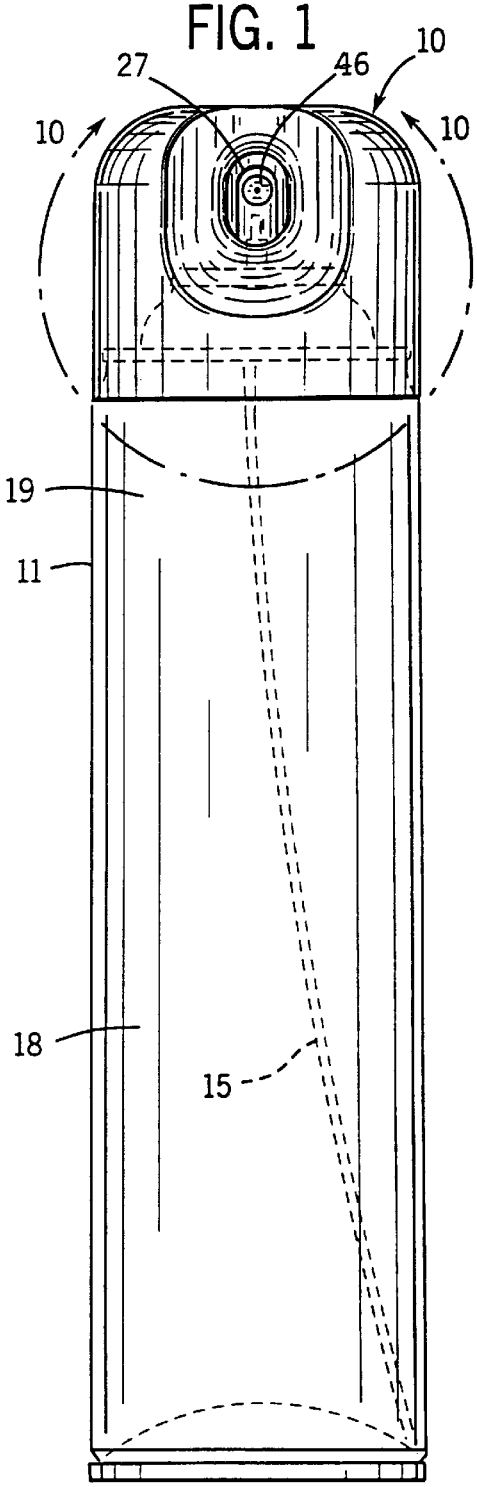
FIG. 1 is a diagrammatic front elevational view of a conventional aerosol canister bearing an actuator overcap of the present invention.
Figure 2:
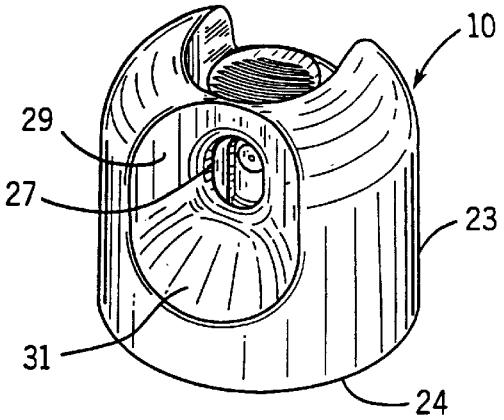
FIG. 2 is a front, top, right perspective view of a preferred actuator overcap of the present invention.
Figure 3:
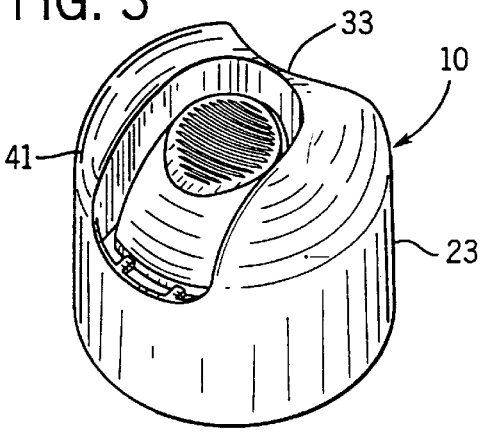
FIG. 3 is a rear, top, right perspective view thereof.
Figure 4:
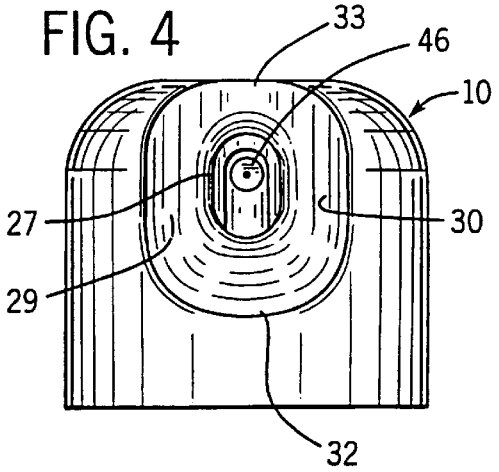
FIG. 4 is a front elevational view thereof, albeit with a button actuator preassembled to it.
Figure 5:
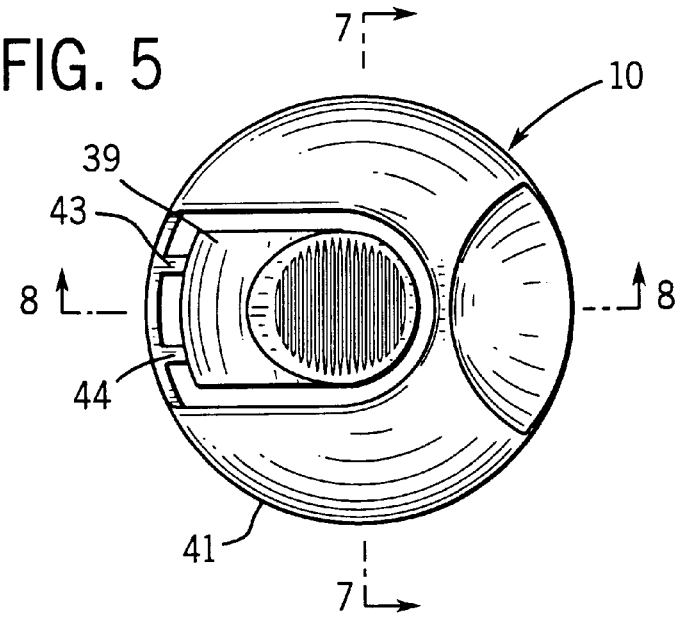
FIG. 5 is a top plan view thereof.

FIG. 1 shows a preferred overcap, generally 10, in conjunction with a conventional canister 11 containing a compressed gas propellant with a consumer product additive (e.g. furniture polish; insecticide; deodorant).

At the top of canister 11 there is a valve stem 13 which is connected to a valve 14 from which a dip tube 15 extends to near the base 12. The dip tube is inclined or bent so that it terminates near one side of the canister.

As is conventional in hand-held aerosol containers, the cylindrical body is linked to a first domed upper portion by a flange or bead 16, and the first domed portion is linked to a central portion carrying the valve by a second flange or bead 17. The canister is filled with a liquid product to be dispensed 18 and pressurized by a gas 19 (e.g. a propane/butane mix).

The cap 10 has a skirt/shroud 23 molded from thermoplastic material. It has a bottom 24 of circular cross section which is of such a size as to be able to be push/snap fit over the outer flange 16 of the canister.

A window aperture 27, whose sides curve inwardly towards the interior of the cap, is provided in the shroud and is defined by curved side walls 29 and 30, curved bottom wall 31 and a top wall 33.

Referring to FIGS. 5–8 and 10, a somewhat cylindrical sleeve or pod 35 is provided in cap 10 having a downwardly open slot 37. The slot is circumferentially aligned with the window 27.

The pod 35 is open at its lower end, and is closed at its upper end. Its upper end forms part of the same plastics molding as a finger panel 39, which in turn forms part of the same plastics molding as the shroud 41. The panel is pivotally linked to the shroud 41 by two living hinges 43 and 44. This enables the pad 39 to move relative to the outer part of the cap in response to finger pressure, and thereby pivot the pod 35 with it.

Pod 35 has an internal diameter which is sized so as to receive a conventional small diameter button actuator 21. The actuator button 21 with a spray nozzle 46 can be inserted into the sleeve 35. The button is of conventional in design except for the engaging means with the pod 35.

Figure 6:
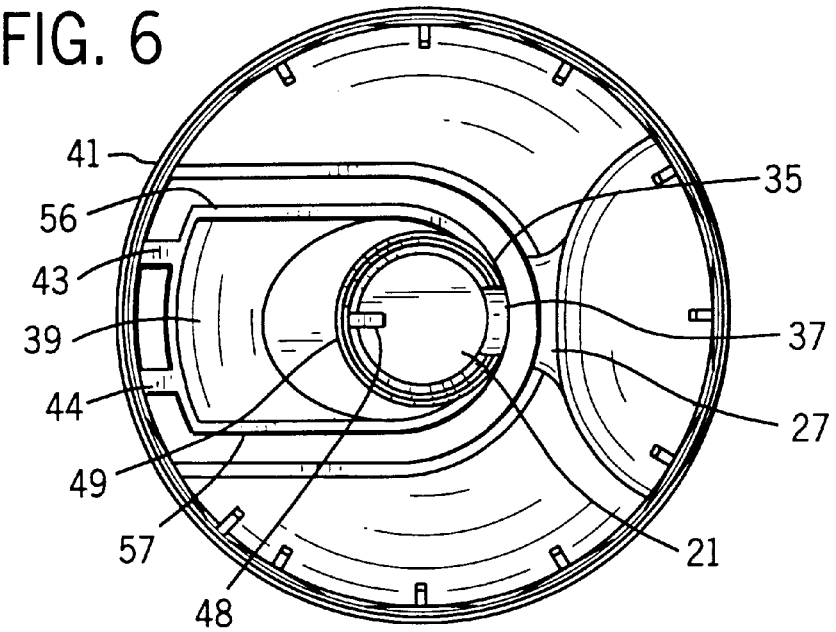
FIG. 6 is a bottom plan view thereof.
Figure 7:
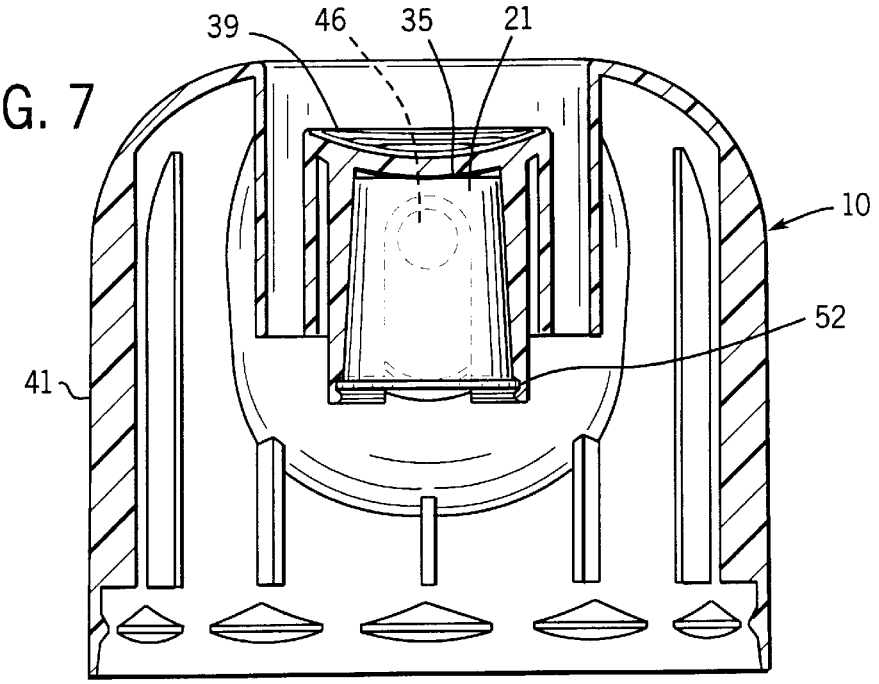
FIG. 7 is a section view along line 7—7 of FIG. 5.
Figure 8:
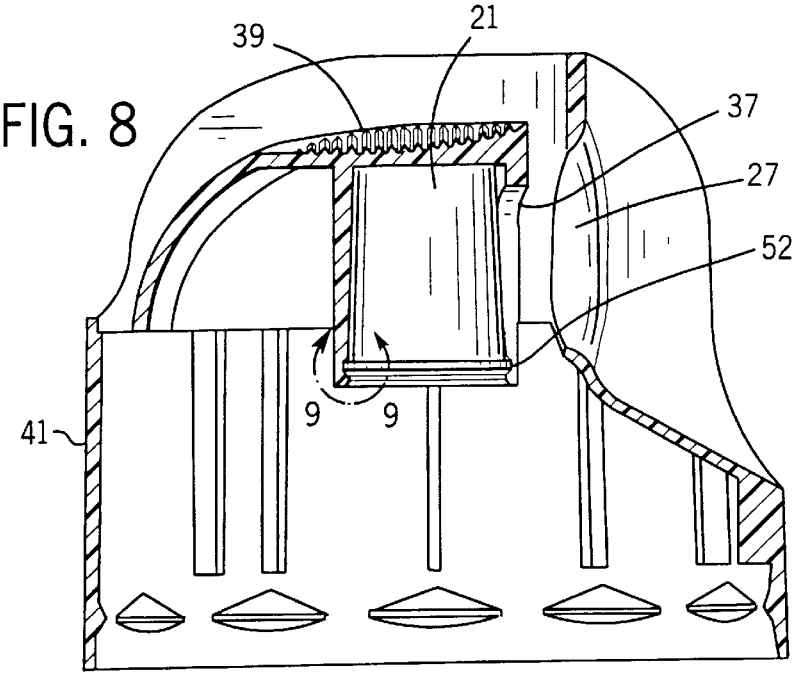
FIG. 8 is a section view along line 8—8 of FIG. 5.
Figure 9:
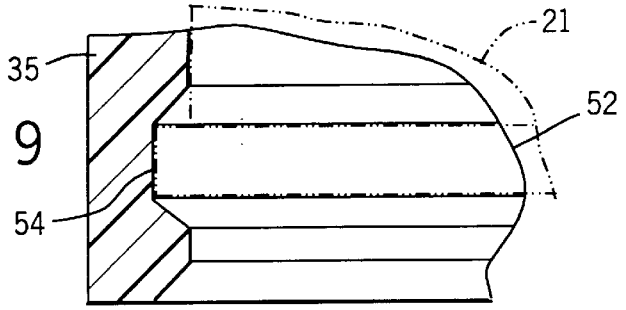
FIG. 9 is an enlarged sectional view focusing on region 9—9 of FIG. 8.
Figure 10:
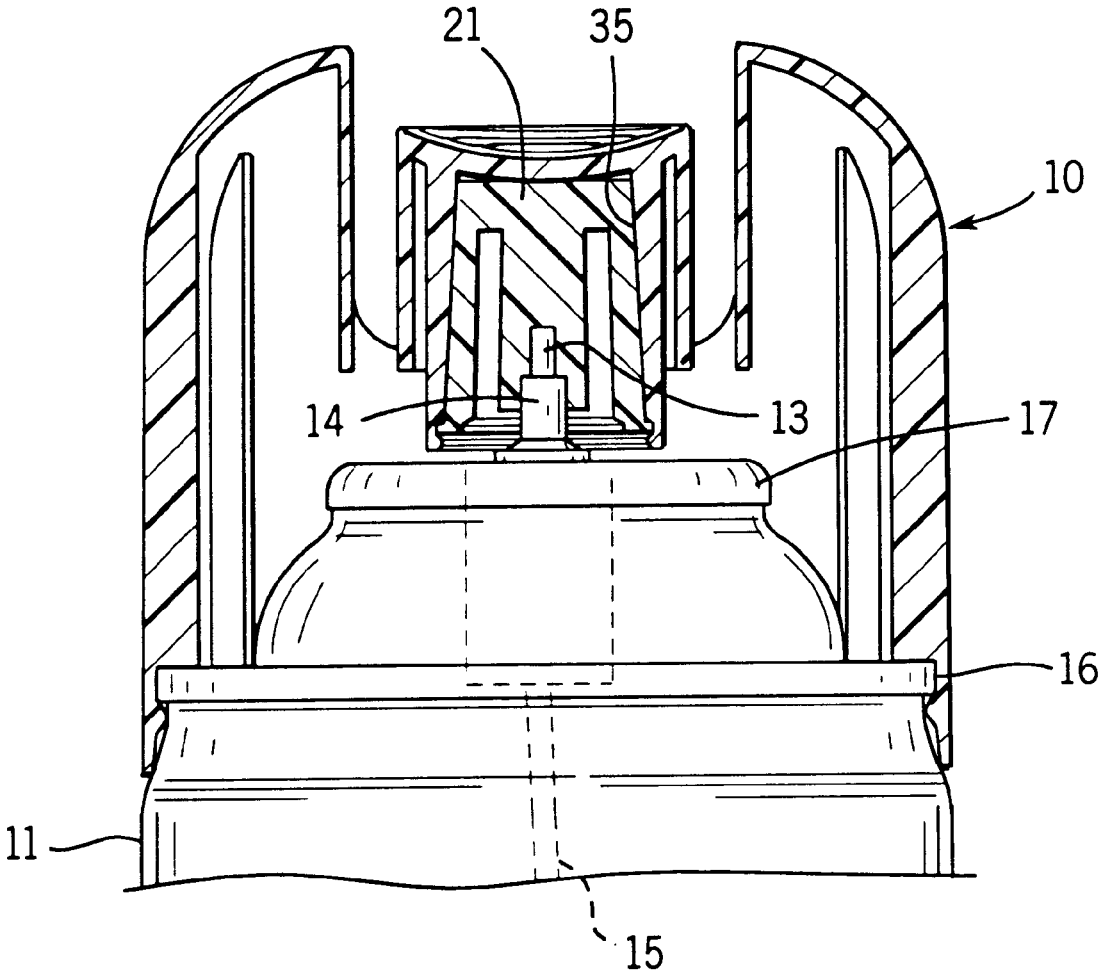
FIG. 10 is an enlarged section view taken along line 10—10 of FIG. 1.

As seen in FIG. 6, one element of the engaging means comprises an axial groove 48 in the side of the button actuator opposite nozzle 46 . This groove 48 receives a corresponding rib 49 extending inward from the inner wall of the sleeve 35, and holds the nozzle 46 in rotational alignment with window 27. Alternatively, the ridge could be on the button actuator and vertical groove in the pod.

Another element of the engaging means is a circumferential ledge or radial projection 52 extending from the base of button 21. The projection is designed to snap fit into circumferential groove 54 of the pod. This provides a secure axial attachment of the button 21 in the pod 35, as well as an attachment which will withstand long periods of operation. It also facilitates ease of automatic assembly.

Caressing arms 56 and 57 depend from panel 39 and support pod 35, notwithstanding the weakness caused by downwardly open slot 37. This provides controlled flexibility for the lower pod. The pod may flex outwardly to receive the button actuator. It then may snap securely back to retain the button in place.

In use, an aerosol canister 11 is charged with product/propellant 18/19. It has at an upper end the usual valve 14 with a valve stem 13.

Overcaps 10 and button actuators 21 are molded, and spray nozzles 46 inserted into the button actuators. The button actuators 21 are then preassembled into the overcaps 10 with the nozzles 46 aligned with the slots 37 and windows 27 in the outer cap 10. The button actuators 21 are retained in caps 10 by the engagement of the projection 52 in the groove 54.

An important aspect of the invention is the flexing of the pod/sleeve 35. This is afforded by the slot 37. This permits assembly to be rapidly done in a packaging line. This also facilitates molding.

It should be appreciated that the above discussion merely relates to preferred forms of the invention. Other forms are also included. For example, groove 48 could be in the pod 35 with the rib 49 on the valve button 21. Further, while the projection 52 and groove 54 are indicated as being continuous (except for slot 37 in groove) they could be interrupted such as with spaced ribs and ledges.

INDUSTRIAL APPLICABILITY

The invention is useful in providing means for dispensing product from aerosol canisters.

I claim:

1. An actuator overcap adapted to fit on a pressurized canister, the overcap comprising:

an outer shroud adapted to fit on the canister, the shroud having an aperture in its side;

an inner pod linked to the shroud for receiving a button actuator of the canister, the pod having a side slot which is aligned with the aperture so as to allow spray to pass from such a button actuator through the slot and aperture and out the shroud;

the side slot being open at its lower end;

the pod having means for restricting rotation of the button actuator relative to the pod, and means for axially retaining the button actuator in the pod which can be activated by axial relative movement between the button and pod so as to provide a snap fit connection between a portion of the button and a side wall of the pod; and an actuator panel that carries the pod and is hingedly mounted to the shroud to pivot the pod relative to the shroud.

2. The overcap of claim 1, wherein the means for axially retaining the button actuator comprises a circumferential inner pod groove.

3. The overcap of claim 1, wherein the panel is connected to the shroud by at least two separate hinge members.

4. A method for mounting a spray cap on a valve stem of an aerosol canister, comprising the steps of:

inserting a button actuator into the pod of the claim 1 overcap to create a preassembly; and mounting the preassembly on the valve stem by inserting the valve stem into the button actuator.

5. An actuator overcap adapted to fit on a pressurized canister, the overcap comprising:

an outer shroud adapted to fit on the canister, the shroud having an aperture in its side;

an inner pod linked to the shroud for receiving a button actuator of the canister, the pod having a side slot which is aligned with the aperture so as to allow spray to pass from such a button actuator through the slot and aperture and out the shroud;

the side slot being open at its lower end;

the pod having means for restricting rotation of the button actuator relative to the pod, and means for axially retaining the button actuator in the pod; and an actuator panel that carries the pod and is hingedly mounted to the shroud to pivot the pod relative to the shroud;

wherein the panel has two caressing webs depending from it which support sides of the pod.

* * * * *